US009953623B2

(12) United States Patent
Usuda

(10) Patent No.: US 9,953,623 B2
(45) Date of Patent: Apr. 24, 2018

(54) MARCHING DRUM WHICH ENABLES FORWARDS AND DOWNWARDS VISIBILITY

(71) Applicant: CANOPUS CO. LTD., Tokyo (JP)

(72) Inventor: Shinichi Usuda, Tokyo (JP)

(73) Assignee: CANOPUS CO. LTD., Tokyo (JP)

( * ) Notice: Subject to any disclaimer, the term of this patent is extended or adjusted under 35 U.S.C. 154(b) by 0 days.

(21) Appl. No.: 15/320,972

(22) PCT Filed: Jun. 18, 2015

(86) PCT No.: PCT/JP2015/067671

§ 371 (c)(1),
(2) Date: Dec. 21, 2016

(87) PCT Pub. No.: WO2015/198971

PCT Pub. Date: Dec. 30, 2015

(65) Prior Publication Data

US 2017/0178609 A1 Jun. 22, 2017

(30) Foreign Application Priority Data

Jun. 23, 2014 (JP) ..... 2014-128666

(51) Int. Cl.
*G10D 13/02* (2006.01)

(52) U.S. Cl.
CPC ..... *G10D 13/028* (2013.01); *G10D 13/02* (2013.01)

(58) Field of Classification Search
CPC ..... G10D 13/028; G10D 13/02
USPC ..... 84/411 R
See application file for complete search history.

(56) References Cited

U.S. PATENT DOCUMENTS 4,045,264 A * 8/1977 Ludwig ..... B29C 53/36 156/203

FOREIGN PATENT DOCUMENTS

| | | |
|---|---|---|
| JP | 2000-293167 A | 10/2000 |
| JP | 2006-146122 | 6/2006 |
| JP | 2008-292808 A | 4/2008 |

OTHER PUBLICATIONS

International Search Report completed Aug. 6, 2015 (submitted herewith) of the ISA (Japanese Patent Office), dated Aug. 18, 2015—All references on this document from ISR.

* cited by examiner

*Primary Examiner* — Jianchun Qin
(74) *Attorney, Agent, or Firm* — PatShegen IP

(57) ABSTRACT

[Problem] To provide a marching drum which ensures forwards and downwards visibility and ensures the field of view during marching. [Solution] [Effect] By eliminating all or some members of the body of the drum, or by adopting transparent members, this marching drum which enables forwards and downwards visibility ensures the performer's field of view during marching.

5 Claims, 9 Drawing Sheets

MARCHING DRUM WHICH ENABLES FORWARDS AND DOWNWARDS VISIBILITY

FIELD OF THE INVENTION

This invention, ensuring visibility of a performer for marching drum, relates to the drum which makes it easy to march.

BACKGROUND OF THE INVENTION

Marching drums, in terms of musical constitution, require their sizes to range from 18" to 40". These drums, without distinction of gender, are hung from the front of the performer's body as shown in FIG. 1, and they are used for performance whilst marching.

SUMMARY OF THE INVENTION

Problem to be Solved by the Invention

When the performer-0 marches, the visibility of the performer-0 is subject to a blind spot obstructed by the drum in area 1 as shown in FIG. 1. Consequently, because the performer-0 cannot view his legs and confirm the direction of movement, the act of marching in performance became very dangerous. Or, in some cases, an attendant is also needed to monitor movement.

Means for Solving the Problem

1. This invention added the below-mentioned improvements to the drum so as to solve the problems mentioned above. Holes 5, 6, and 7 as shown in FIG. 12, that were made on a part of the body of drum 100, enables forwards and downwards visibility.

2. Reduction of acoustic performance of drum is prevented, even when adding transparent members as 12 in FIG. 14 on places as 11 in FIG. 13 where holes are and even if by making these holes.

3. Transparent members, such as 8, 9, and 10 in FIG. 7 and FIG. 8, as members forming a part of the body of drum 300 in FIG. 15, forwards and downwards visibility is ensured.

4. Transparent member 20 in FIG. 18 mounted along the circumference of the midsection of the body 2 of drum 500 in FIG. 17, creates the structure by which forwards and downwards visibility 1 can be ensured.

5. Supporting members for attaching the drum heads (skins) 18 and 19 on both sides of drum 600 of FIG. 19 with bracket (lugs) 22 to fix the drum head (skin) as the hitting surface of drum. A portion 21 with no solid member is formed at the midsection of the drum body 2. The portion 21 is configured such that forwards and downwards visibility 1 can be ensured. If the parts attaching the drum heads (skins) 18 and 19 are made from transparent members, optimum visibility can be ensured.

Effects of the Invention

According to this invention, there are the following effects.

1. It is safe for the performer to march while performing, since the performer can look forwards and downwards.

2. The attendant whilst moving becomes unnecessary.

DESCRIPTION OF THE PREFERRED EMBODIMENTS

This invention is explained in detail with figures of actual examples below.

Example 1 of Performance of the Invention

Figure 1:
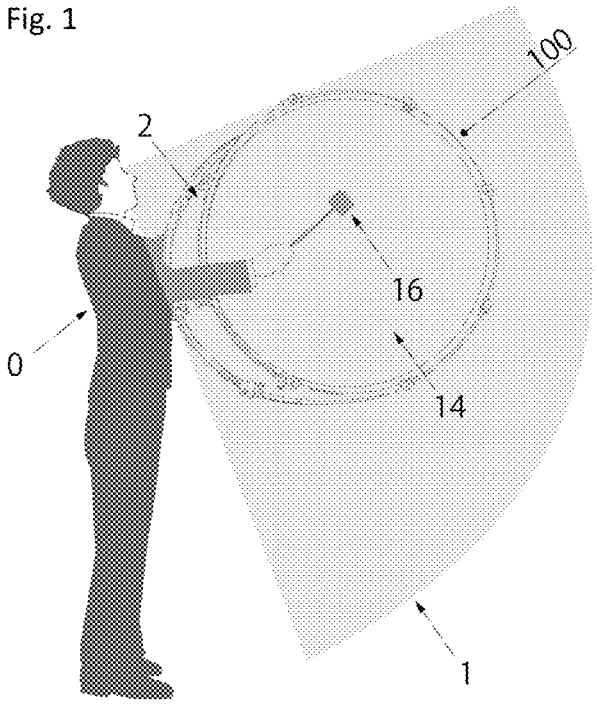
FIG. 1 is a side view, in which the performer-0 performs while hanging drum 100 from the front.
Figure 2:
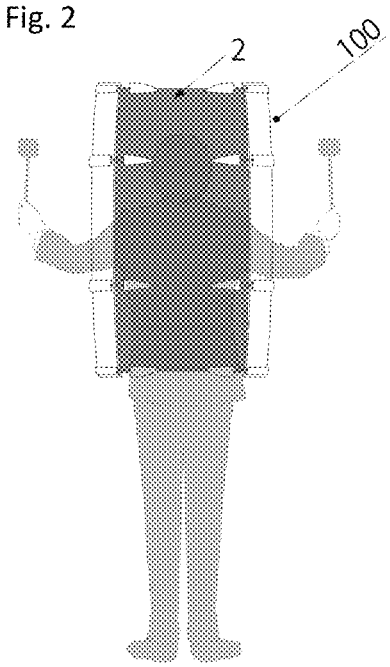
FIG. 2 is a rear view, in which the performer-0 performs while hanging drum 100 from the front.

FIG. 1 shows a performer-0 which hangs a regular drum 100 from the front. Such embodiment, when the performer-0 performs and marches along, creats a blind spot for the performer-0 as 1 in FIG. 1 because the body 2 of the drum 100 confronts the front of the performer-0's face as shown in FIG. 2. For this reason, when the performer-0 generally marches, they generally have to march primarily by predicting forwards and downwards visibility based only upon the surroundings, making it extremely difficult for the performer-0 to perform, also creating a potentially dangerous situation.

In addition, in a case of the performer-0's carrying drum 100 before or after the performance, the attendant is generally needed. This invention is purposed to remove the necessity of the attendant due to movement, in order to eliminate this blind spot, to ensure visibility of the performer and for the performer-0 to march safely as it performs.

Three (3) following methods are considered to ensure visibility.

1. Adopting transparent members as material of the drum body like drum 400 in FIG. 9.

Figure 6:
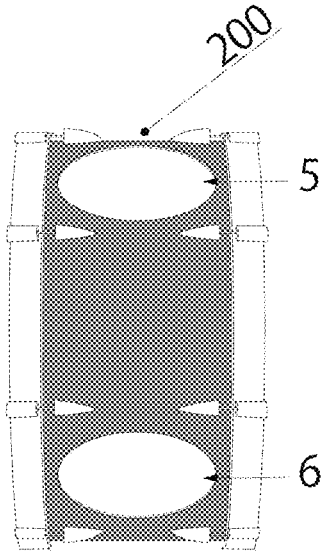
FIG. 6 shows the opposite side of the performer-0 for drum 200 made with a circular opening on the drum for passage of the line of sight

2. Forming holes 5, 6 and 7 at certain locations on a part of the body 2 of the drum, where visibility of the performer-0 is interrupted, like drum 200 in FIG. 6, or to put transparent members 11 and 12 on the openings of the drum.

Figure 7:
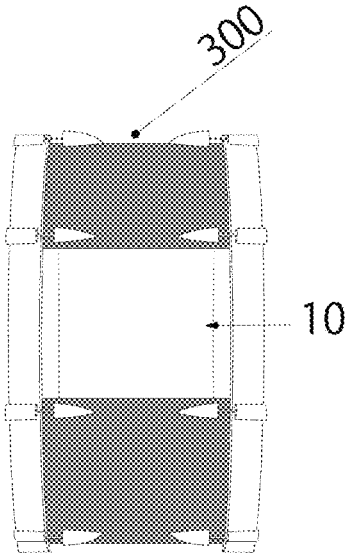
FIG. 7 shows the side of the performer-0 for drum 300 replaced with a transparent member for a part of the drum body
Figure 8:
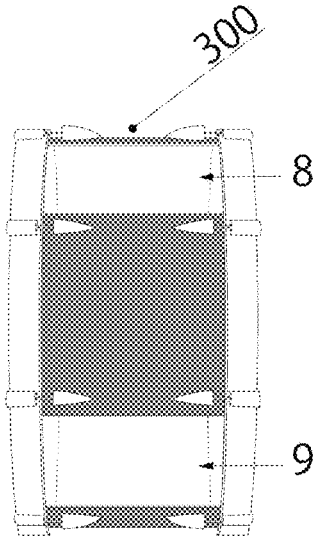
FIG. 8 shows the opposite side of the performer-0 for drum 300 replaced with a transparent member for a part of the drum body
Figure 10:
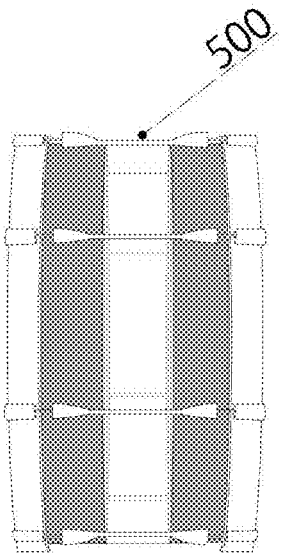
FIG. 10 is a drum 500 utilizing a transparent member as the midsection of the drum body material
Figure 11:
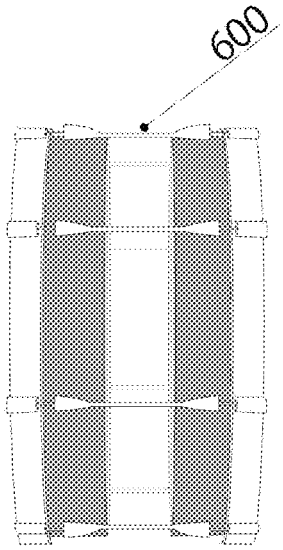
FIG. 11 is a drum 600, with a clearance provided at the midsection of the drum body, but utilized without any members on the midsection of the drum body FIG. 12 indicates a position where a circular opening is provided on drum 200
Figure 12:
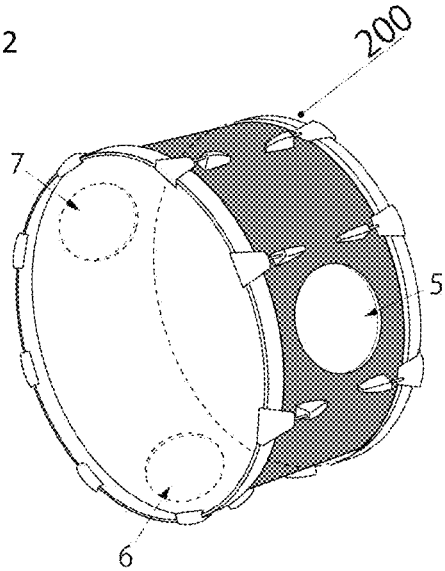
Figure 13:
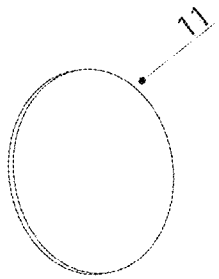
FIG. 13 shows a circular member to close the opening provided on drum 200
Figure 14:
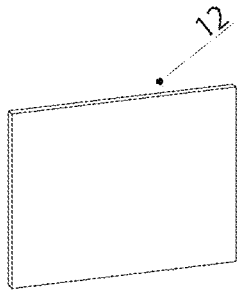
FIG. 14 shows a square member to close the opening provided on drum 200

3. Adopting transparent members 13 and 20 on a part of the body 2 of the drum, where visibility of the performer-0 is interrupted, like drum 300 in FIG. 7 and drum 500 in FIG. 10.

Figure 19:
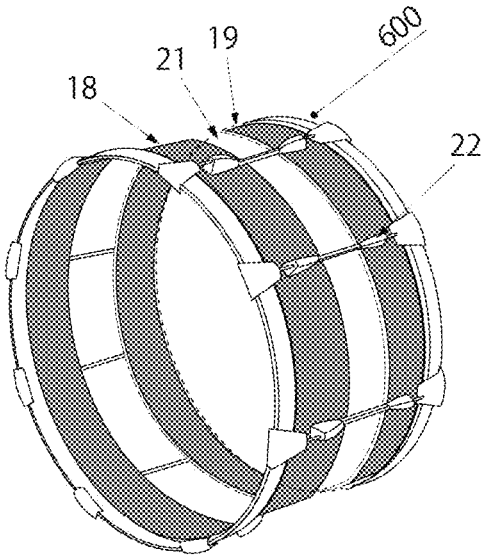
FIG. 19 shows a drum, with a clearance provided at the midsection of the drum body

4. Forming a structure with a clearance 21 adopted like drum 600 in FIG. 19, without the use of any members along the circumference of the midsection of the body 2, where visibility of the performer-0 is interrupted, like drum 600 in FIG. 19.

Figure 9:
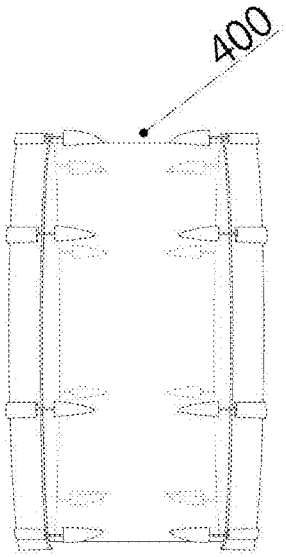
FIG. 9 is a drum 400 utilizing a transparent member as the drum body material

As for the method-1, provided that members similar to acrylic materials like drum 400 in FIG. 9 are utilized, the problems can be solved. However, the size of the drum as mentioned previously generally ranges from 18" till 40". As the size of drum 100 increases, there is also a problem that drum 100 becomes too heavy to be carried, without distinction of gender, even if visibility is ensured. This is due to the fact that acrylic material is generally very heavy as compared with wood.

Figure 3:
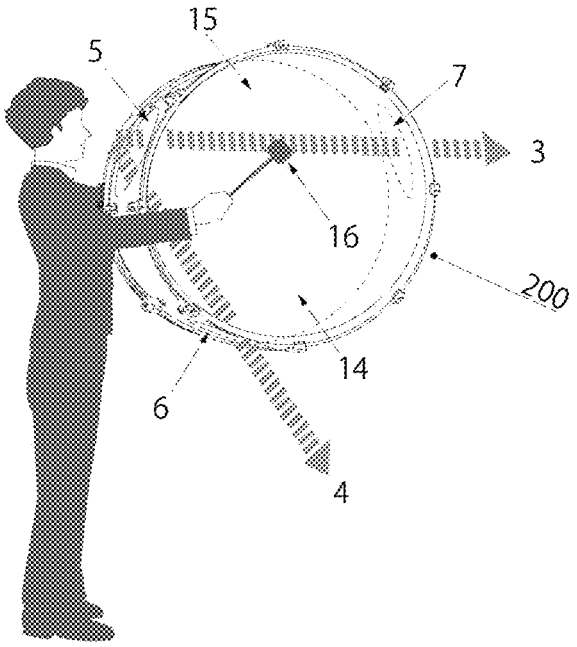
FIG. 3 is a side view, to indicate the line of sight of the performer-0
Figure 4:
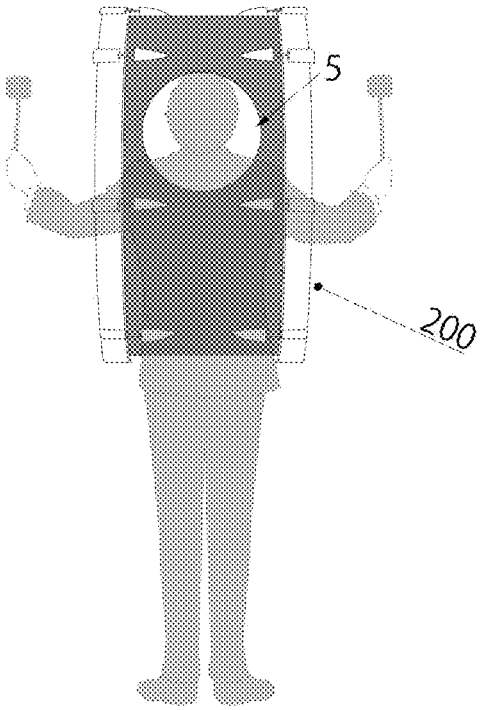
FIG. 4 is a rear view, to indicate the line of sight of the performer-0
Figure 5:
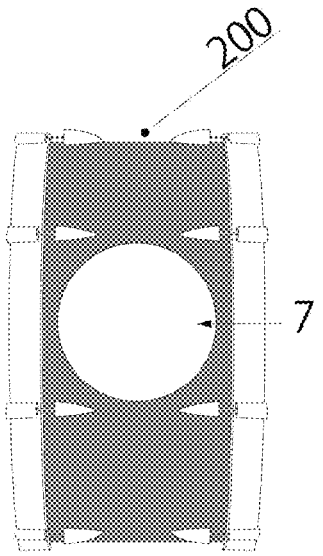
FIG. 5 shows the side of the performer-0 for drum 200 made with a circular opening on the drum for passage of the line of sight

As for the method-2, by forming opening 5 on the side of the performer-0 and an opening 7 on the opposite side of the performer-0 in the body of drum 200, as shown in FIG. 3, the front visibility of the performer-0 as 3 in FIG. 3 can be ensured.

In the same way as above, by forming an opening 6 on the body 2 of the drum, the downwards visibility (4) can be also ensured.

An acoustic problem is caused by this kind of processing. In the case of a regular drum 100 in FIG. 1, when the performer-0 beats the drum head (skin) 14 as the hitting surface of drum with beater 16, air inside drum 100 unable to escape is forced towards to the opposite side of the drum head (skin) 15, and the drum head (skin) 14 as the hitting surface of drum is forced out because the forced drum head (skin) 15 of the drum causes to recover with its restoring force. This action of repletion enables the powerful sound of the drum to be emitted, and gradually to be attenuated.

The drum in this invention is equipped with holes 5, 6, and 7 on the body of drum 200 in FIG. 3. With reference to playing the drum as in performance, the desired purpose of this invention can be fully accomplished. However, the volume of drum sound is reduced and its tone color gets worse too because inside air escapes through these three holes on drum 200. Closing the openings of holes 5, 6, and 7 with transparent members 11 or 12, prevents the deterioration in the tone color of the drum. Furthermore, it goes without saying that the shape of the transparent member as mentioned above is not limited to a circle or square, but any shape can be utilized if it's ensures the visibility.

Figure 15:
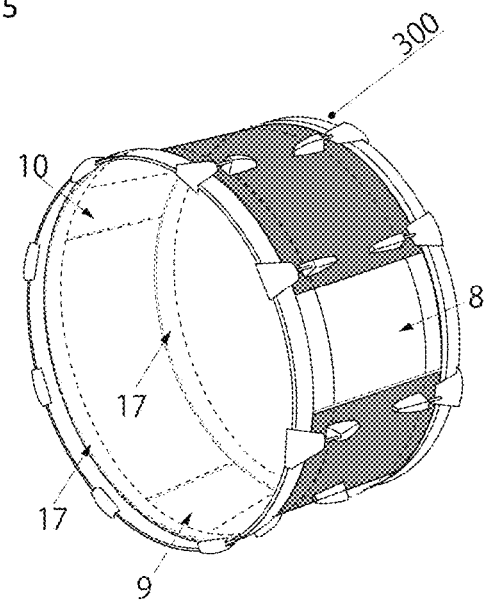
FIG. 15 is a drum 300, with a transparent member adopted for a part of the drum body
Figure 16:
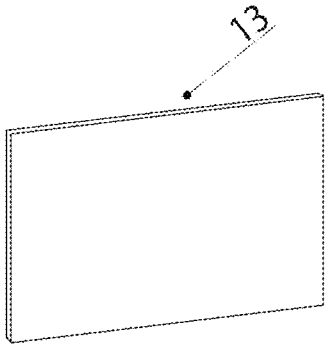
FIG. 16 shows a transparent square member, constituting a part of the body of drum 300

As for the method-3, forwards visibility of the performer-0 can be ensured by making use of square transparent sections 10 and 8 on the body 2 of drum 300 as shown in FIG. 15. In the same way as above, downwards visibility can be also ensured by making use of a square transparent member 9 on the body 2 of the drum.

In order to produce drum 300, by arranging a transparent component 13 on each of the openings 8, 9 and 10, the body 2 of the drum is produced. In order to ensure the strength and to maintain the round shape of the drum a reinforcing material 17 as shown in FIG. 15 and the like, can be used.

Further, it goes without saying that the position of the opening is not limited to the openings like as 8, 9 and 10, but any position of the opening is possible if it ensures the required visibility.

Figure 17:
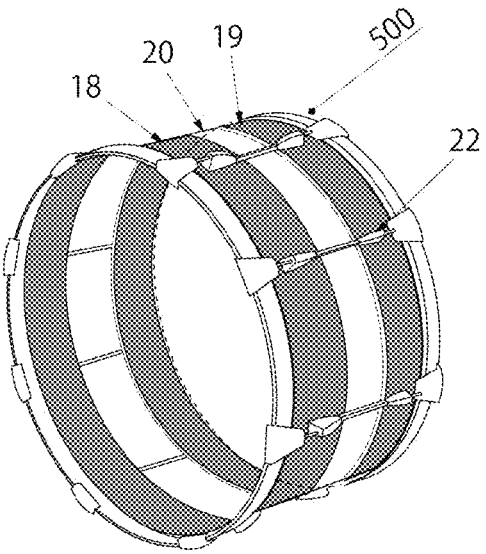
FIG. 17 shows a drum, in which a transparent member is utilized at the midsection of the drum body
Figure 18:
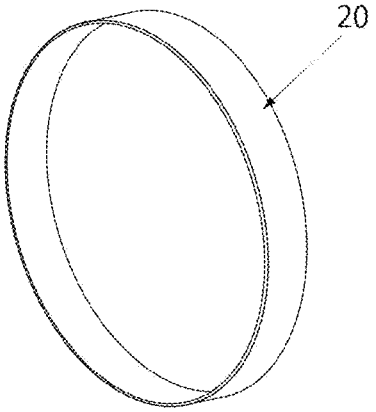
FIG. 18 is a transparent member for the midsection of the body of drum 600

As for the method-4, a transparent member 20 is sandwiched to fit in the midsection of the body of drum 500 as shown in FIG. 17 with both members to attach to—the drum heads (skins) 18 and 19, and hardware (lugs) to hold the drum head (skin) as the hitting surface of drum. The transparent member 20 ensure forwards and downwards visibility 1.

Further, it goes without saying that the position of the transparent member is not limited to the midsection of the drum and on the circumference of the drum, but any shape is available if ensures the required visibility.

As for the method-5, the midsection of the body of drum 600, is formed with learance 21 without use of transparent member 20. Composing the drum 600 with bracket (lugs) 22 to fix the drum head (skin) and members to fix the drum heads (skins) 18 and 19, it can ensure its forwards and downwards visibility 1.

Further, it goes without saying that the position of the clearance is not limited to the midsection of the body of the drum, but any position is possible if it ensures the required visibility.

DESCRIPTION OF THE NUMERAL REFERENCES

100 bass drum for marching in general
200 drum, which is made with circular shapes on its body providing visibility
300 drum, which is made with square transparent members on a par to it
400 drum, in which transparent members are used on its body
500 drum, in which transparent members are used on its body
600 drum, in which a clearance is made at the midsection of its body
0 performer
1 Blind spot of the performer
2 body of the drum
3 forwards visibility of the performer-0
4 downwards visibility of the performer-0
5 circular hole located at the side of the performer, to ensure the forwards visibility of the performer-0
6 circular hole located at the opposite side of the performer, to ensure the downwards visibility of the performer-0
7 circular hole located at the opposite side of the performer, to ensure the forwards visibility of the performer-0
8 square opening located at the side of the performer, to ensure the forwards visibility of the performer-0
9 square opening located at the opposite side of the performer, to ensure the forwards visibility of the performer-0
10 square opening located at the opposite side of the performer, to ensure the forwards visibility of the performer-0
11 circular transparent member, to close the openings made in the drum 200
12 square transparent member, to close the openings made in the drum 200
13 square transparent member, composing a part of the body of the drum 300
14 drum head (skin) for the hitting surface of the drum

15 drum head (skin) for the opposite side of the hitting surface of the drum
16 beater, to beat the drum
17 reinforced material, for reinforcing the body of drum 300
18 member to fix a drum head (skin) of drum 500
19 other member to fix a drum head (skin) of drum 500
20 transparent members on the midsection of drum 500
21 portion without any members on the midsection of drum 600
22 hardware (lug) to fix the drum head (skin) of the drum

The invention claimed is:

1. A marching drum comprising a drum body having a circumferential portion and two head portions vertically disposed, said circumferential portion is configured for being mounted in front of a user face while said user is marching, such that said circumferential portion intersects a line of sight between the user's face and at least a forward distant point wherein said circumferential portion includes at least one opening formed along said line of sight allowing the user to view said distant point through said opening and wherein said at least one opening is closed with a transparent member configured to preclude a deterioration in a tone color of the drum.

2. The marching drum of claim 1 wherein said at least one opening includes two openings formed on the circumferential portion such that said line of sight is formed through said two openings.

3. The marching drum of claim 1 wherein said at least one opening includes a first opening, a second opening and a third opening each of which being formed on the circumferential portion such that a first line of sight extends through said first and second openings and a second line of sight extends through said first and third openings.

4. The marching drum of claim 1 wherein said circumferential portion include two side parts and wherein said at least one opening is formed along the circumference between said side parts.

5. The marching drum of claim 4 wherein said side parts are coupled to one another with brackets.

* * * * *